US012264492B2

(12) United States Patent
Qiu et al.

(10) Patent No.: US 12,264,492 B2
(45) Date of Patent: Apr. 1, 2025

(54) FOLDABLE TENT WITH CENTRAL LIFTING AND AUTOMATIC OPENING AND CLOSING STRUCTURE

(71) Applicant: Wuyi Letu Leisure Products Co.,Ltd, Jinhua (CN)

(72) Inventors: Xin Qiu, Jinhua (CN); Huakai Pan, Jinhua (CN); Xuanyin Tao, Jinhua (CN)

( * ) Notice: Subject to any disclaimer, the term of this patent is extended or adjusted under 35 U.S.C. 154(b) by 147 days.

(21) Appl. No.: 18/113,066

(22) Filed: Feb. 23, 2023

(65) Prior Publication Data

US 2023/0193651 A1 Jun. 22, 2023

(30) Foreign Application Priority Data

Dec. 1, 2022 (CN) ..... 202223242164.4

(51) Int. Cl.
*E04H 15/48* (2006.01)
*E04H 15/32* (2006.01)
*E04H 15/50* (2006.01)

(52) U.S. Cl.
CPC ..... *E04H 15/48* (2013.01); *E04H 15/32* (2013.01); *E04H 15/50* (2013.01)

(58) Field of Classification Search
CPC ..... E04H 15/50
See application file for complete search history.

(56) References Cited

U.S. PATENT DOCUMENTS 5,421,356 A * 6/1995 Lynch ..... E04H 15/50 411/338
5,444,946 A * 8/1995 Zeigler ..... E04H 15/50 135/147
7,409,963 B2 * 8/2008 Mallookis ..... E04H 15/50 135/144
7,422,026 B2 * 9/2008 Kim ..... E04H 15/50 135/120.2
9,303,428 B1 * 4/2016 Wu ..... E04H 15/50
9,995,056 B2 * 6/2018 Yang ..... E04H 15/50
10,378,235 B1 * 8/2019 Volin ..... E04H 15/46
(Continued)

FOREIGN PATENT DOCUMENTS

CN 110630085 A * 12/2019 ..... E04H 15/26
CN 213269215 U * 5/2021 ..... E04H 15/28
(Continued)

*Primary Examiner* — David R Dunn
*Assistant Examiner* — Danielle Jackson
(74) *Attorney, Agent, or Firm* — Sandy Lipkin

(57) ABSTRACT

Disclosed is a foldable tent with central lifting and automatic opening and closing structure, including a central bracket group and inclined frames. The central bracket group includes an upper frame and a base bracket. The inclined frame includes a first inclined rod hinged with the upper frame at one end, and a second inclined rod hinged with the first inclined rod at one end. The upper frame includes an upper top and a middle piece. The upper top is provided with a mounting hole in a non-circular structure. The middle piece is provided with an upper section and a lower section both in a non-circular structure. The lower section is provided with a spring pin. The base bracket is provided with an insertion hole in a non-circular structure. The side wall of the insertion hole is provided with a pin hole capable of locking the spring pin.

9 Claims, 9 Drawing Sheets

(56) References Cited

U.S. PATENT DOCUMENTS

| | | | | |
|---|---|---|---|---|
| 10,995,515 | B2 * | 5/2021 | Zingerle | E04B 1/3441 |
| 11,306,502 | B2 * | 4/2022 | Chen | E04H 15/50 |
| D1,038,306 | S * | 8/2024 | Qiu | D21/839 |
| 2014/0261601 | A1 | 9/2014 | Jin | |
| 2015/0068573 | A1 | 3/2015 | Jin | |
| 2015/0167344 | A1 | 6/2015 | Jin | |
| 2020/0347635 | A1 * | 11/2020 | Sun | E04H 15/50 |
| 2023/0203834 | A1 * | 6/2023 | Qiu | E04H 15/18 135/131 |
| 2024/0068267 | A1 * | 2/2024 | Yang | E04H 15/50 |

FOREIGN PATENT DOCUMENTS

| | | | | |
|---|---|---|---|---|
| CN | 213359579 U * | 6/2021 | | E04H 15/48 |
| CN | 217300086 U * | 8/2022 | | |
| CN | 218522391 U * | 2/2023 | | E04H 15/50 |

* cited by examiner

FOLDABLE TENT WITH CENTRAL LIFTING AND AUTOMATIC OPENING AND CLOSING STRUCTURE

CROSS REFERENCE TO RELATED APPLICATION

This patent application claims the benefit and priority of Chinese Patent Application No. 202223242164.4 filed on Dec. 1, 2022, the disclosure of which is incorporated by reference herein in its entirety as part of the present application.

TECHNICAL FIELD

The present disclosure relates to the technical field of foldable tents, and more specifically, to a foldable tent with central lifting and automatic opening and closing structure.

BACKGROUND ART

Tent is a kind of shed that is propped on the ground to shelter from wind, rain or sunlight. It is usually used when going for an outing or doing business on open land. Because foldable tent can be quickly unfolded to support a large-area shed or folded into a small volume folding shape that is easy to carry, it is very popular with outdoor campers or outdoor booth workers for its practicality.

In order to facilitate the foldable tent to be unfolded independently and conveniently by one person, some foldable tents, such as locking bracket of umbrella frame for foldable tent and umbrella frame for quick splicing of foldable tent with the issuing publication No. CN213359579U, can reduce the space between the first part and the second part by operating the first part at the center of the tent to rise, and the support rod on the second part is inserted into the first part. In addition, the first part and the support rod are locked by the spring pin. After the first part and the second part are locked, the space between the four corners of the foldable tent is gradually expanded due to the expansion of the first part of the inclined frame of the foldable tent during the rising process. After the space between the first part and the second part is fixed, the foldable tent is fully expanded.

However, the straight rod with spring pin in the above disclosure is installed on the second part by inserting, and is actually fixed by pasting with glue or screwing. Since there is no relative positioning structure between the support rod and the second part, there is no reference positioning structure when the support rod is fixed on the second part, so that the alignment between the spring pin on the straight rod and the pin hole on the first part is not clear, that is, the spring pin on the straight rod is very easy to be installed inappropriately due to the deflection installation of the straight rod on the second part, which causes the spring pin on the straight rod to stagger with the hole on the first part, making the first part and the second part unable to be locked and connected through the spring pin on the straight rod, affecting the assembly accuracy.

SUMMARY

Aiming at the problem that the straight rod with the spring pin in the exist tent is installed inappropriately due to no installation and positioning structure, so that the first part and the second part cannot be locked and connected by the spring pin on the straight rod, the technical problem to be solved by the present disclosure is to provide a foldable tent with central lifting and automatic opening and closing structure, which can ensure the matching accuracy between the spring pin on the middle piece and the pin hole on the side wall on one side of the insertion hole of the base bracket by the cooperation of non-circular structure between the middle piece with the spring pin on the upper frame and the upper top, so that the middle piece can not be deflected during installation.

The technical scheme adopted by the present disclosure to solve the above technical problems is as follows. A foldable tent with central lifting and automatic opening and closing structure is provided, including a central bracket group and at least three groups of inclined frames. The central bracket group includes an upper frame and a base bracket, any group of the inclined frames includes a first inclined rod and a second inclined rod, one end of the second inclined rod is hinged on the first inclined rod, and the other end of the second inclined rod is hinged on the base bracket.

The upper frame includes an upper top and a middle piece, one end of the first inclined rod is hinged on the upper top, the upper top is provided with a first mounting hole in a non-circular structure, the middle piece is provided with an upper section and a lower section both in a non-circular structure, a side wall of the lower section is provided with a partially protruding spring pin, and the middle piece is completely inserted into the first mounting hole through the upper section and fixed.

An upper end of the base bracket is provided with an insertion hole in a non-circular structure, a side wall on one side of the insertion hole is provided with a pin hole capable of locking the spring pin, the lower section can be fully inserted into the insertion hole, and the lower section limits a connection between the upper frame and the base bracket by inserting the spring pin into the pin hole.

A further preferred scheme of the present disclosure is as follows: a lower end of the lower section is provided with a tip in a non-cone structure, the tip is inserted into and connected to the lower section, and the tip is larger in upper part and smaller in lower part.

A further preferred scheme of the present disclosure is as follows: the base bracket is provided with a notch, and the notch obliquely connects to the side wall on one side of the insertion hole and an end face connected to an opening of the insertion hole.

A further preferred scheme of the present disclosure is as follows: the base bracket is provided with a switch piece in a U-shaped structure, and the switch piece is provided with a pressing part for pressing the spring pin to disengage from the pin hole.

A further preferred scheme of the present disclosure is as follows: the pressing part is provided with a convex point, and the convex point conflicts with the spring pin.

A further preferred scheme of the present disclosure is as follows: the base bracket includes a lower support and a socket piece, the lower support is provided with a second mounting hole with an upper opening and a non-circular structure, the socket piece is provided with an insertion section in a non-circular structure, and the socket piece is fixed by completely inserting the insertion section into the second mounting hole.

A further preferred scheme of the present disclosure is as follows: the socket piece is provided with a socket section, the socket section is arranged above the insertion section, and the insertion hole, the pin hole and the notch are all arranged on the socket section, and the switch piece is fixed on the socket section.

A further preferred scheme of the present disclosure is as follows: the middle piece is provided with a middle section, an outer size of the middle section is larger than the outer size of the upper section and the lower section, the upper frame is inserted with and connected to the base bracket, and the middle section is exposed between the upper top and the socket section.

A further preferred scheme of the present disclosure is as follows: the upper top is provided with multiple first hinge slots hinged one-to-one with the first inclined rods, the lower support is provided with multiple second hinge slots hinged one-to-one with the second inclined rods, and the upper top is provided with multiple shelving slots penetrating from top to bottom, and the shelving slots are distributed between slot walls of two the adjacent first hinge slots.

A further preferred scheme of the present disclosure is as follows: a side wall of the first mounting hole and a side wall of the second mounting hole are respectively provided with a limit slot, and the upper section and the insertion section are respectively provided with a limit bar matching with the limit slot.

Compared with the prior art, the disclosure has the following beneficial effects.

1. Through the insertion and coordination of non-circular structure between the middle piece and the mounting hole of the upper top, the installation position of the middle piece relative to the upper top is effectively limited to ensure that the middle piece will not deflect when installed on the upper top. That is, when both the upper frame and the base bracket are connected with the inclined frames, the matching accuracy of the spring pin and pin hole between the upper frame and the base bracket is ensured, and it is ensured that the upper frame and the base bracket are connected through the limit of the spring pin.
2. The upper section of the middle piece is completely inserted into the mounting hole of the upper top, and the lower end of the middle piece is completely inserted into the insertion hole of the base bracket, which ensures that the upper section and the lower section of the middle piece are not exposed when the middle piece is fixedly connected with the upper top and the base bracket, improves the firmness and stability of the central bracket group, and thus improves the structural stability when the tent is unfolded as a whole.

BRIEF DESCRIPTION OF THE DRAWINGS

Hereinafter, the present disclosure will be described in further detail with reference to the accompanying drawings and preferred embodiments. However, it will be appreciated that, for those skilled in the art, the drawings are drawn merely for the purpose of illustrating the preferred embodiments, and therefore should not be taken as limiting the scope of the disclosure. In addition, unless specified, the drawings are merely illustrative in conceptual representation of the composition or construction of the objects described and may include exaggerated displays, and are not necessarily drawn to scale.

In the figures: 001. central bracket group: 01. upper frame: 1. upper top, 1-1, first hinge slot, 1-2, first mounting hole, 1-3, shelving slot: 2. middle piece, 2-1, upper section, 2-2, middle section, 2-3, lower section, 2-4, first limit bar; 3. tip, 3-1, inserting section, 3-2, convex part: 4. spring pin: 02. base bracket: 5. lower bracket, 5-1, second hinge slot, 5-2, second mounting hole; 6. socket piece, 6-1, socket section, 6-2, insertion hole, 6-3, pin hole, 6-4, notch, 6-5, insertion section: 7. switch piece, 7-1. hollowed-out opening, 7-2. pressing part, 7-3. convex point:

002. inclined frame: 8. first inclined rod: 9. second inclined rod: 10. third inclined rod: 11. fourth inclined rod: 12. S-buckle:

003. corner group: 13. longitudinal tube: 14. end sleeve: 15. sliding sleeve; 16. foot sleeve: 17. pressing piece: 18. telescopic tube: 19. foot:

004. fork frame, 004*a*, first upper end, 004*b*, first lower end, 004*c*, second upper end, 004*d*, second lower end: 20, first fork rod: 21. second fork bar.

DETAILED DESCRIPTION OF THE EMBODIMENTS

Preferred embodiments of the present disclosure will be described in detail below with reference to the accompanying drawings, and those skilled in the art will appreciate that the descriptions are only illustrative and exemplary, and should not be construed as limiting the scope of protection of the present disclosure.

It should be noted that like reference numbers refer to similar items in the following figures, and thus, once an item is defined in one figure, it may not be further defined and explained in subsequent figures.

The embodiment mainly describes a foldable tent with central lifting and automatic opening and closing structure, which can ensure the matching accuracy between the spring pin on the middle piece and the pin hole on the side wall on one side of the insertion hole of the base bracket by the cooperation of non-circular structure between the middle piece with the spring pin on the upper frame and the upper top so that the middle piece can not be deflected during installation. The details are as follows.

Figure 1:
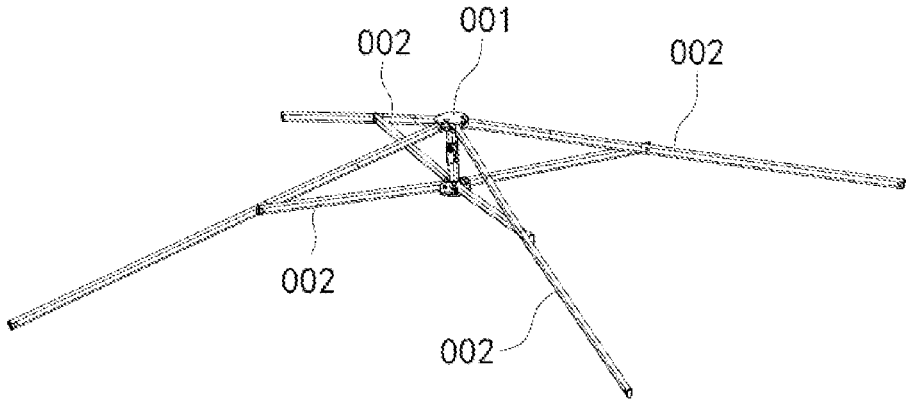
FIG. 1 is the structural diagram of the connection between the central bracket group and the inclined frame in the preferred embodiment of the present disclosure.
Figure 2:
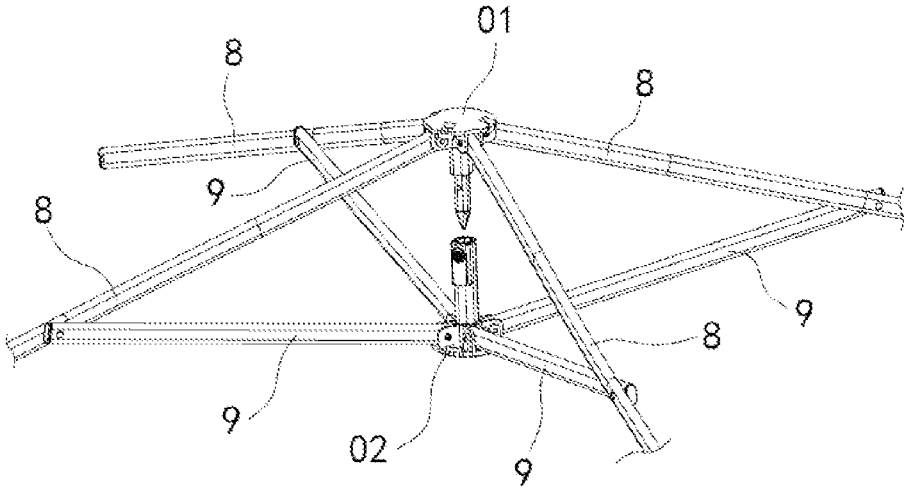
FIG. 2 is the structural diagram of the upper frame separated from the base bracket and connected with the inclined frame in the preferred embodiment of the present disclosure.

As shown in FIG. 1 and FIG. 2, the foldable tent with central lifting and automatic opening and closing structure includes the central bracket group 001 and the inclined frame 002. In the present embodiment, the central bracket group 001 is connected with four groups of inclined frames 002, and the four groups of inclined frames 002 are distributed in an annular array around the longitudinal center of the central bracket group 001.

One group of the central bracket group 001 includes an upper frame 01 and a base bracket 02 which are matched and connected in limit position through the spring pin 4 and the pin hole 6-3. The inclined frame 002 includes a first inclined rod 8 hinged with the upper frame 01 at one end, and a second inclined rod 9 hinged with the base bracket 02 at one end. The other end of the second inclined rod 9 is hinged on the first inclined rod 8. Preferably, the upper frame 01 is arranged above the base bracket 02, and the length of the second inclined rod 9 is shorter than that of the first inclined rod 8.

Figure 3:
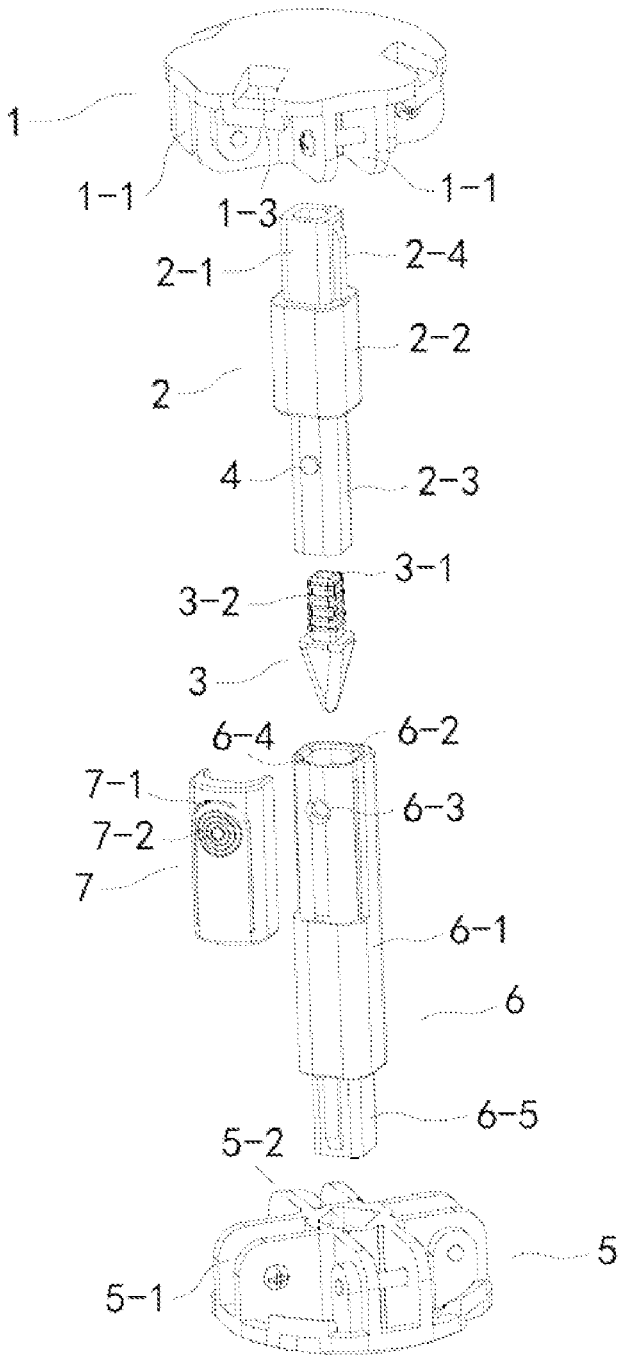
FIG. 3 is an exploded view of the upper frame and the base bracket of the preferred embodiment of the present disclosure.
Figure 4:
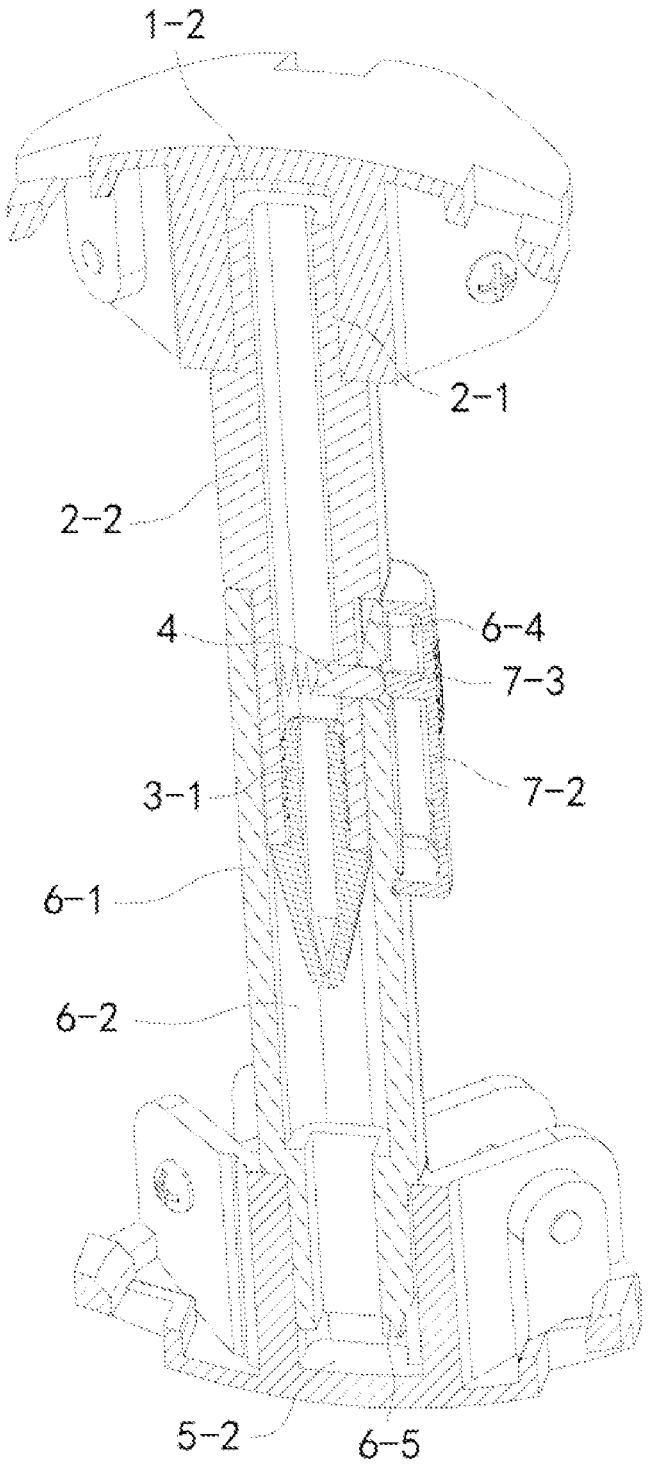
FIG. 4 is a sectional view of the upper bracket and the base bracket in the preferred embodiment of the present disclosure.
Figure 5:
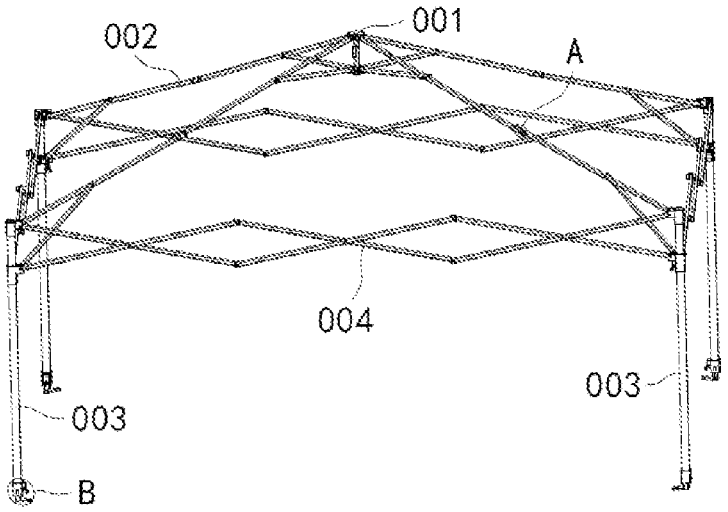
FIG. 5 is the structural diagram of the central bracket group when applied to the tent in the preferred embodiment of the present disclosure.
Figure 6:
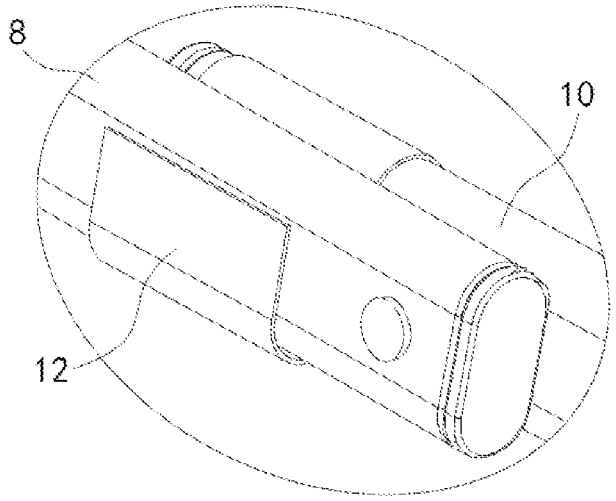
FIG. 6 is an enlarged schematic diagram of part A in FIG. 5 of the preferred embodiment of the present disclosure.
Figure 7:
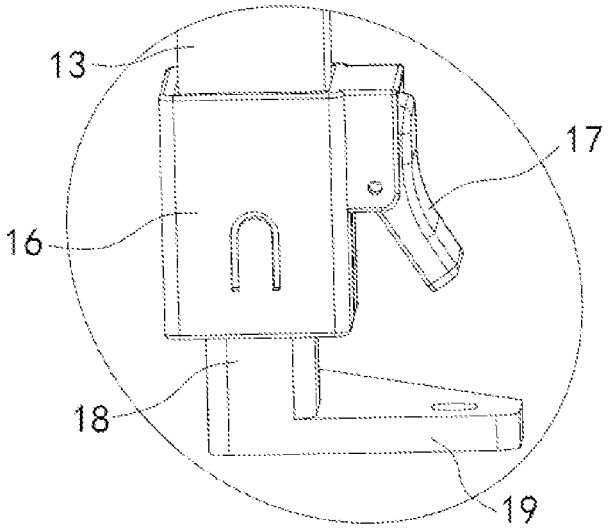
FIG. 7 is an enlarged schematic diagram of part B in FIG. 5 of the preferred embodiment of the present disclosure.
Figure 8:
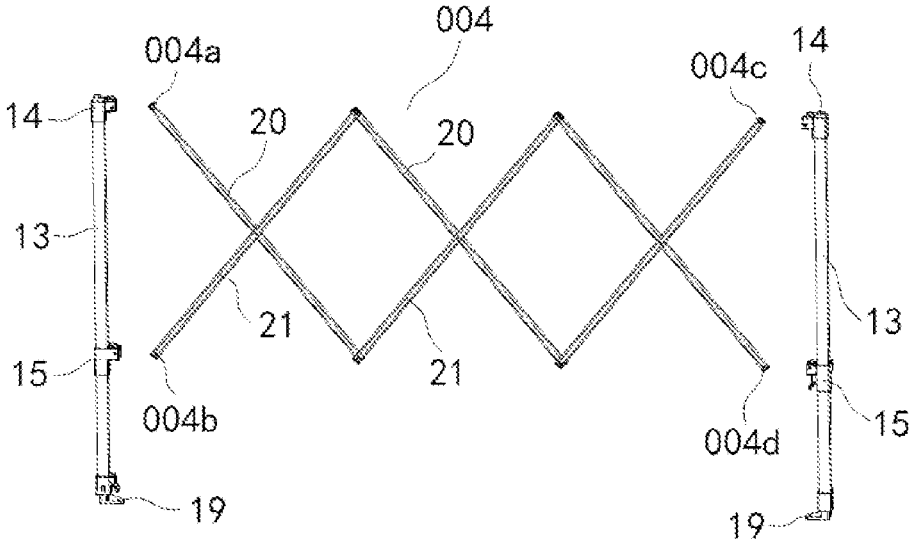
FIG. 8 is an exploded view of two the corner groups and a fork frame in the preferred embodiment of the present disclosure.
Figure 9:
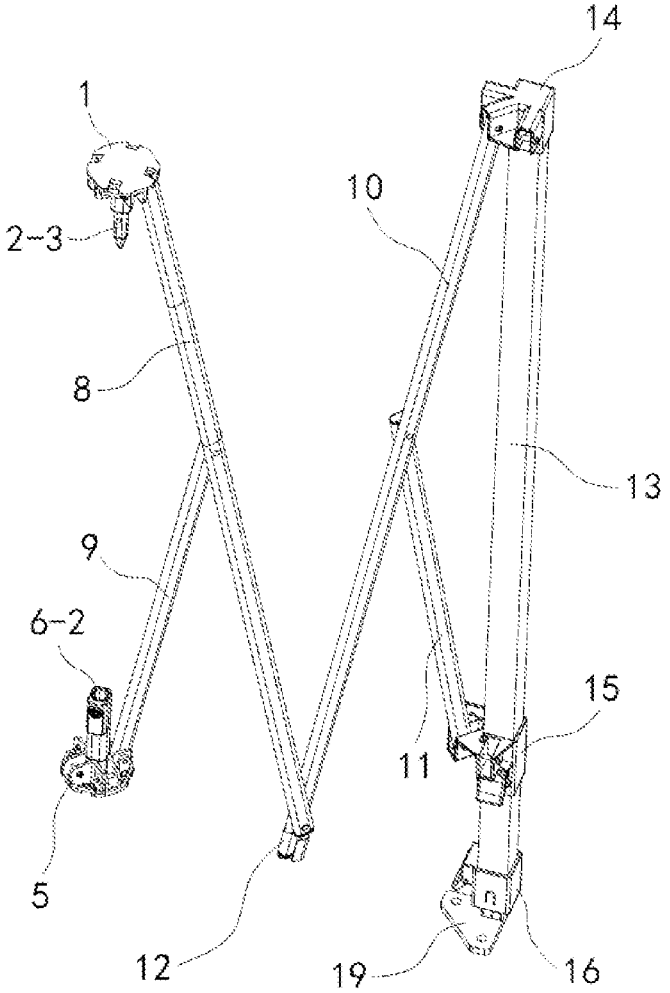
FIG. 9 is the structural diagram of the inclined frame connecting the corner groups in the preferred embodiment of the present disclosure.

As shown in FIG. 3 and FIG. 4, the upper frame 01 includes an upper top 1, middle piece 2 and tip 3. The middle piece 2 is inserted and installed under the upper top 1, the tip 3 is inserted and installed under the middle piece 2, and the spring pin 4 is installed on the middle piece 2. The upper top 1, middle piece 2 and tip 3 are generally injection molded with plastic or other materials. In order to save injection materials and facilitate the installation of spring pin 4 on middle piece 2, middle piece 2 is set in a tube structure, and the tip 3 is in a non-circular structure with a larger top and a smaller bottom, that is, a cone structure. In addition, the upper end surface of the tip 3 is provided with an inserting section 3-1, the inserting section 3-1 is inserted into the lower section 2-3 of the middle piece 2 and fixed, the outer wall of the inserting section 3-1 is provided with multiple convex parts 3-2 distributed up and down, and the tip 3 is fixed by interference with the inner wall of the lower section 2-3 of the middle piece 2 through the multiple convex parts 3-2. Preferably, in order to facilitate mold opening and demoulding, the upper top 1, the middle piece 2 and the tip 3 are separately arranged.

The upper top 1 is provided with a first mounting hole 1-2 in a non-circular structure. The middle piece 2 can be divided into upper section 2-1, middle section 2-2 and lower section 2-3 from top to bottom. The upper section 2-1, middle section 2-2 and lower section 2-3 are all in non-circular structures, and the spring pin 4 is installed on the lower section 2-3. Moreover, the outer wall size of the middle section 2-2 is larger than that of the upper section 2-1 and the lower section 2-3. The middle piece 2 is inserted into the first mounting hole 1-2 through the upper section 2-1, and fixed to connect the middle piece 2 and the upper top 1 through glue pasting or screwing in the outer wall of the first mounting hole 1-2. The upper section 2-1 of the middle piece 2 is completely inserted into the first mounting hole 1-2 of the upper top 1. In addition, the upper end of the middle section 2-2 is butted and fitted with the end face of the first mounting hole 1-2, that is, the lower end face of the upper top 1. Preferably, the non-circular structure of the first mounting hole 1-2 and the upper section 2-1 enables the middle piece 2 to effectively avoid the deflection of the middle piece 2 when it is installed in the first mounting hole 1-2 of the upper top 1 through the upper section 2-1, and ensures the anti-deflection installation when the middle piece 2 is inserted into the upper top 1.

In order to ensure the locking position of the spring pin 4 when the upper frame 01 corresponds to the base bracket 02, the first limit slot is set on the side wall of the first mounting hole 1-2, and the limit bar 2-4 is set on the side wall of the upper section 2-1, which is located in the first limit slot, so that the directional installation of the middle piece 2 and the upper top 1 can be realized by limiting the first limit slot and the limit bar 2-4. Preferably, when the upper section 2-1 of the middle piece 2 and the first mounting hole 1-2 of the upper top 1 are set to be cylindrical, the setting of the first limiting slot and the limit bar 2-4 not only restricts the deflection when the middle piece 2 is connected with the upper top 1, but also restricts the directional installation of the middle piece 2 and the upper top 1.

The upper frame 01 is hinged with the first inclined rod 8 on the inclined frame 002 through the upper top 1. In this embodiment, the upper top 1 is provided with four first hinge slots 1-1, one end of the first inclined rod 8 is arranged in the first hinge slot 1-1 one-to-one, and the first inclined rod 8 is arranged in the first hinge slot 1-1 for rotary connection through screws or pin shafts and other accessories. The first hinge slot 1-1 connects the lower end face of the upper top 1 and the outer wall on the same side.

In this embodiment, the base bracket 02 includes the lower bracket 5, the socket piece 6 and the switch piece 7 which are integrally formed respectively. The socket piece 6 is inserted and installed above the lower bracket 5. The switch piece 7 covers and is fixed on the side wall on one side of the upper end of the socket piece 6 in a U-shaped structure. The switch piece 7 is provided with a pressing part 7-2 that can be pressed movably. In this embodiment, the switch piece 7 is provided with a hollowed-out opening 7-1, one end of the pressing part 7-2 is connected to the side wall of the hollowed-out opening 7-1, and a gap is left between the other edges and the hollowed-out opening 7-1, so that the other end of the pressing part 7-2 can be pressed, while the wall surface inside the other end of the pressing part 7-2 is provided with a convex point 7-3.

The lower bracket 5 is provided with a non-circular second mounting hole 5-2. The socket piece 6 can be divided into an insertion section 6-5 and a socket section 6-1 from top to bottom. Both the insertion section 6-5 and the socket section 6-1 are non-circular. The socket section 6-1 is provided with an insertion hole 6-2 for the insertion of the lower section 2-3 of the middle piece 2 and the tip 3. The pin hole 6-3 matched with the spring pin 4 penetrates the side wall on one side of the insertion hole 6-2. The outer wall size of the socket section 6-1 is larger than the outer wall size of the insertion section 6-5. Preferably, the connection mode and matching structure between the insertion section 6-5 and the second mounting hole 5-2 are the same as those between the upper section 2-1 and the first mounting hole 1-2.

The base bracket 02 is hinged with the second inclined rod 9 on the inclined frame 002 through the lower bracket 5. In this embodiment, the lower bracket 5 is provided with four second hinge slots 5-1, one end of the second inclined rod 9 is arranged in the second hinge slot 5-1 one-to-one, and the second inclined rod 9 is arranged in the second hinge slot 5-1 for rotary connection through screws or pin shafts and other accessories. The second hinge slot 5-1 connects the upper end face of the lower bracket 5 and the outer wall on the same side.

By holding the outer wall of the socket section 6-1, and turning the base bracket 02 to drive the second inclined rod towards the upper end of the first inclined rod 8, the base bracket 02 moves vertically upward relative to the upper frame 01, the lower section 2-3 of the middle piece 2 and the tip 3 are completely inserted into the insertion hole 6-2 of the socket section 6-1 of the socket piece 6, and the spring pin 4 on the lower section 2-3 of the middle piece 2 falls into the pin hole 6-3 of the side wall of the insertion hole 6-2 of the socket piece 6, and the spring pin 4 and the pin hole 6-3 cooperate to lock and connect the upper frame 01 and the base bracket 02.

By pressing the pressing part 7-2 of the switch piece 7, the convex point 7-3 on the other end of the pressing part 7-2 collides with the spring pin 4 and pushes the spring pin 4 away from the pin hole 6-3, so that the upper frame 01 can be separated from the base bracket 02.

In this embodiment, the lower section 2-3 of the middle piece 2 is adapted to the insertion hole 6-2 on the socket piece 6. In order to prevent the spring pin 4 from being stuck on the end face of the insertion hole 6-2 opening when it is inserted into the insertion hole 6-2, the insertion hole 6-2 of the socket piece 6 is provided with a notch 6-4. The notch 6-4 connects obliquely the side wall on the insertion hole 6-2 side and the end face where the insertion hole 6-2 opening is connected. The inclined wall of the notch 6-4 is arranged to guide the compression of the spring pin 4 when it enters the insertion hole 6-2.

As shown in FIG. 5 to FIG. 9, besides the central bracket group 001 and four groups of inclined frames 002, the tent frame also includes four groups of corner groups 003 and four groups of fork frames 004, wherein four groups of corner groups 003 are connected head to tail through four groups of fork frames 004, that is, one group of corner groups 003 is connected with two groups of fork frames 004, while each group of corner groups 003 is installed with one group of inclined frames 002, and the inclined frames 002 are connected between the two groups of fork frames 004.

The inclined frame 002 also includes a third inclined rod 10 and a fourth inclined rod 11. The third inclined rod 10 is hinged with the other end of the first inclined rod 8, and the end of the third inclined rod 10 adjacent to the first inclined rod 8 deviates from the hinge point of the third inclined rod 10 and the first inclined rod 8. The third inclined rod 10 is fixed with an S-buckle 12 between the hinge point of the third inclined rod 10 and the first inclined rod 8. After the tent is fully unfolded, the S-buckle 12 can limit the downward rotation of the first inclined rod 8 relative to the third inclined rod 10. One end of the fourth inclined rod 11 is hinged on the third inclined rod 10. The length of fourth inclined rod 11 is shorter than that of the third inclined rod 10, and both the third inclined rod 10 and fourth inclined rod 11 are hinged on the corner frame.

A group of the corner groups 003 includes a longitudinal tube 13, an end sleeve 14 arranged on the upper end of the longitudinal tube 13, and a sliding sleeve 15 slidingly installed on the longitudinal tube 13. The other end of the third inclined rod 10 is hinged on the end sleeve 14, while the other end of the fourth inclined rod 11 is hinged on the sliding sleeve 15.

A group of fork frames 004 includes multiple groups of first fork rods 20 and second fork rods 21 hinged in the centers. Two first fork rods 20 of two adjacent groups are parallel, and two second fork rods 21 of two adjacent groups are parallel. A group of fork frames 004 are reserved with four unconnected ends. In this embodiment, the prefix of the end on the same side is added to the first to name it, and it is distinguished by the upper and lower positions, that is, the upper end of one side of a group of fork frames 004 is the first upper end 004*a*, the lower end on the same side is the first lower end 004*b*, and the prefix of the end on the other side is changed to the second.

When the fork frames 004 of two groups of corner groups 003 are connected, the first upper end 004*a* of the fork frame 004 is hinged with the end sleeve 14 of one side corner group 003, and the first lower end 004*b* of the fork frame 004 is hinged with the sliding sleeve 15 of the corner group 003 on the same side. The second upper end 004*c* of the fork 004 is hinged with the end sleeve 14 of the corner group 003 on the other side, and the second lower end 004*d* of the fork 004 is hinged with the sliding sleeve 15 of the corner group 003 on the other side.

In order to adjust the total height of the tent, a telescopic tube 18 is slidably inserted in and connected with the longitudinal tube 13 of the corner group 003, and a foot sleeve 16 is arranged at the lower end of the longitudinal tube 13, on which a pressing piece 17 is rotatably installed. The foot sleeve 16 and the pressing piece 17 are rotated and reset through a torsion spring. In addition, the foot sleeve 16 and the longitudinal tube 13 are slidably installed with a pin. The pressing piece 17 pushes and presses the pin under the action of the torsion spring, and the pin blocks the telescopic tube 18. The pin restricts the telescoping motion of the telescopic tube 18 relative to the longitudinal tube 13. When it is necessary to adjust the extension length of the telescopic tube 18, it is only necessary to press the pressing piece 17. The pressing piece 17 rotates so that the pin does not conflict with the telescopic tube 18, and the telescopic tube 18 can stretch and move relative to the longitudinal tube 13.

When the base bracket 02 is separated from the upper frame 01 by operating the base bracket 02, because the hinge between the first inclined rod 8 and the third inclined rod 10 can move down and turn over, that is, the distance between the corner group 003 and the central bracket group 001 is reduced, the distance between the two corner groups 003 is reduced, and the distance between the sliding sleeve 15 on the longitudinal tube 13 and the end sleeve 14 is increased. On the contrary, by supporting the base bracket 02, the base bracket 02 and the upper frame 01 are locked through the cooperation of spring pin 4 and the pin hole 6-3, the S-buckle 12 restricts the rotation between the first inclined rod 8 and the third inclined rod 10, that is, the length of the extension between the first inclined rod 8 and the third inclined rod 10 is the longest, and the distance between the corner group 003 and the central bracket group 001 is the largest and fixed, then the distance between the two corner groups 003 reaches the maximum under the restriction of the inclined frame 002, while the distance between the sliding sleeve 15 on the longitudinal pipe 13 and the end sleeve 14 is reduced to fixed.

In this embodiment, the lower end of the telescopic tube 18 is fixed with a foot 19, which has the function of restricting the telescopic tube 18 from fully retracting into the longitudinal tube 13, and the foot 19 is arranged so that the tent can be closer to the ground when standing.

The upper top 1 is provided with multiple shelving slots 1-3 that run through from top to bottom, and the shelving slots 1-3 are distributed between the slot walls of two adjacent first hinged slots 1-1. In order to ensure the stability of the tent after unfolded, a shelving rod can be added. Both ends of the shelving rod are equipped with C-shaped buckles or U-shaped buckles. One end of the shelving rod is fastened to the shelving slots 1-3 through the C-shaped buckles or U-shaped buckles, and the other end is fastened to the first fork rod 20 or second fork rod 21 of the fork frame 004. Preferably, the shelving rod can be connected to the first fork rod 20 or second fork rod 21 near the center of the fork frame 004.

In the description of the present disclosure, it should be noted that the orientation or positional relationship indicated by the terms "up". "down", "front", "back", "inside", "outside" and the like is based on the orientation or positional relationship shown in the drawings, or is the orientation or position relationship of the product of the present disclosure that is traditionally placed when the product of the utility model is used. The orientation or positional relationship is only for the convenience of describing the present disclosure and simplifying the description of the present disclosure, rather than indicating or implying that the device or element referred to must have a particular orientation, be constructed and operated in a particular orientation, and therefore it cannot be construed as a limitation of the present disclosure.

The foldable tent foldable tent with central lifting and automatic opening and closing structure provided by the present disclosure is described in detail above, and the principle and implementation mode of the present disclosure are described in this paper by specific embodiments. The description of the above embodiments is only for helping to understand the present disclosure and its core idea. And it should be pointed out that for those skilled in the art, without departing from the principles of the present disclosure, it is also possible to make certain improvements and modifications to the present disclosure, which are also within the protection scope of the claims of the present disclosure.

What is claimed is:

1. A foldable tent with central lifting and automatic opening and closing structure, comprising a central bracket group and at least three groups of inclined frames, wherein the central bracket group comprises an upper frame and a base bracket, any group of the inclined frames comprises a first inclined rod and a second inclined rod, one end of the second inclined rod is hinged on the first inclined rod, and the other end of the second inclined rod is hinged on the base bracket;

wherein, the upper frame comprises an upper top and a middle piece, one end of the first inclined rod is hinged on the upper top, the upper top is provided with a first mounting hole in a non-circular structure, the middle piece is provided with an upper section and a lower section both in a non-circular structure, a side wall of the lower section is provided with a partially protruding spring pin, and the upper section of the middle piece is completely inserted into the first mounting hole and fixed; and an upper end of the base bracket is provided with an insertion hole in a non-circular structure, a side wall on one side of the insertion hole is provided with a pin hole capable of locking the spring pin, the lower section can be fully inserted into the insertion hole, and the lower section limits a connection between the upper frame and the base bracket by inserting the spring pin into the pin hole;

wherein the base bracket comprises a lower support and a socket piece, the lower support is provided with a second mounting hole with an upper opening and a non-circular structure, the socket piece is provided with an insertion section in a non-circular structure, and the socket piece is fixed by completely inserting the insertion section into the second mounting hole.

2. The foldable tent with central lifting and automatic opening and closing structure of claim 1, wherein a lower end of the lower section is provided with a tip in a cone structure, the tip is inserted into and connected to the lower section, and the tip is larger in an upper part and smaller in a lower part.

3. The foldable tent with central lifting and automatic opening and closing structure of claim 1, wherein the base bracket is provided with a notch, and the notch obliquely connects to the side wall on one side of the insertion hole and an end face connected to an opening of the insertion hole.

4. The foldable tent with central lifting and automatic opening and closing structure of claim 3, wherein the base bracket is provided with a switch piece in a U-shaped structure, and the switch piece is provided with a pressing part for pressing the spring pin to disengage from the pin hole.

5. The foldable tent with central lifting and automatic opening and closing structure of claim 4, wherein the pressing part is provided with a convex point configured to resist against the spring pin.

6. The foldable tent with central lifting and automatic opening and closing structure of claim 4, wherein the socket piece is provided with a socket section arranged above the insertion section, wherein the insertion hole, the pin hole and the notch are all arranged on the socket section, and the switch piece is fixed on the socket section.

7. The foldable tent with central lifting and automatic opening and closing structure of claim 6, wherein the middle piece is provided with a middle section, an outer size of the middle section is larger than the outer size of the upper section and the lower section, the lower section of the upper frame is inserted into and connected to the base bracket, and the middle section is exposed between the upper top and the socket section.

8. The foldable tent with central lifting and automatic opening and closing structure of claim 1, wherein the upper top is provided with a plurality of first hinge slots hinged one-to-one with the first inclined rods, the lower support is provided with a plurality of second hinge slots hinged one-to-one with the second inclined rods, and the upper top is provided with a plurality of shelving slots penetrating from top to bottom, and the shelving slots are distributed between slot walls of two adjacent first hinge slots.

9. The foldable tent with central lifting and automatic opening and closing structure of claim 1, wherein a side wall of the first mounting hole and a side wall of the second mounting hole are respectively provided with a limit slot, and the upper section and the insertion section are respectively provided with a limit bar matching with the limit slot.

* * * * *